US005660753A

United States Patent [19]

Lingnau

[11] Patent Number: 5,660,753

[45] Date of Patent: Aug. 26, 1997

[54] APPARATUS FOR HIGH FREQUENCY INDUCTION HEATING FOR THE REMOVAL OF COATINGS FROM METAL SURFACES

[76] Inventor: David Grant Lingnau, 10030 Oakmoor Way, Calgary Alberta, Canada, T2V 4S8

[21] Appl. No.: 491,026

[22] Filed: Jun. 16, 1995

[51] Int. Cl.[6] ..... H05B 6/10

[52] U.S. Cl. ..... 219/635; 219/675; 219/676; 219/660; 134/17

[58] Field of Search ..... 219/635, 680, 219/670, 672, 673, 675, 676, 677, 632, 660; 134/17, 38

[56] References Cited

U.S. PATENT DOCUMENTS

| | | | |
|---|---|---|---|
| 1,104,499 | 7/1914 | Heany | 219/635 |
| 2,711,984 | 6/1955 | Kingman | 219/635 |
| 3,403,240 | 9/1968 | Henderdon et al. | 219/632 |
| 4,355,222 | 10/1982 | Geithman et al. | 219/635 |
| 4,649,249 | 3/1987 | Odor | 219/676 |
| 4,705,574 | 11/1987 | Burckhardt et al. | 134/17 |
| 5,101,086 | 3/1992 | Dion et al. | 219/677 |

FOREIGN PATENT DOCUMENTS

| | | |
|---|---|---|
| 0 243 340 | 10/1987 | European Pat. Off. . |
| 37 40 859 | 6/1988 | Germany . |
| 38 38 214 | 5/1990 | Germany . |
| 39 27 432 | 2/1991 | Germany . |
| 43 04 551 | 2/1994 | Germany . |
| 2 052 836 | 1/1981 | United Kingdom . |

*Primary Examiner*—Philip H. Leung

*Attorney, Agent, or Firm*—Harry M. Weiss; Jeffrey D. Moy; Harry M. Weiss & Associates, P.C.

[57] ABSTRACT

An apparatus for heating a metal surface to remove a nonferrous thermosetting resin coating bonded to the metal surface. The apparatus uses a power supply device for providing an approximately 75–100 kW signal at approximately 10–40 kHz to the apparatus. A coil assembly device is coupled to the power supply device for producing a high frequency inductive field which will penetrate through the nonferrous thermosetting resin coating with virtually no attenuation and will induce an eddy current of sufficient power in the underlying metal substrate to rapidly heat the interface to a sufficient temperature to immediately destroy the interface bond between the nonferrous thermosetting coating and the metal substrate.

9 Claims, 5 Drawing Sheets

APPARATUS FOR HIGH FREQUENCY INDUCTION HEATING FOR THE REMOVAL OF COATINGS FROM METAL SURFACES

BACKGROUND OF THE INVENTION

1. Field of the Invention

This invention relates generally to coating removal devices and, more specifically, to an apparatus and method for high frequency induction heating for the removal of nonmetallic coatings from metal surfaces.

2. Background of the Invention

The performance and reliability of high technology ice breaker coatings on ships and drill rigs have proven inconsistent and unpredictable. Thus, major coating repairs are often necessary. To repair a coating, it is necessary to strip off all of the old coating down to the bare metal surface and recoat a large continuous area of the surface, as opposed to recoating small bare spots on the metal surface.

Conventional methods of repairing coatings have been found to be uneconomical. Thus, repair operations have been limited in scope to spot repairs and overcoating, neither of which provide a lasting solution to coating failures.

One method of spot repairing old coatings is grit blasting. However, grit blasting provides poor stripping rates, typically around 10–20 minutes per square foot. This is due to the fact that aged and failing ice breaker coatings still retain strong bond strengths of 500–1000 psi (pounds per square inch) and are thick and inherently resilient. Another problem with grit blasting deals with the logistics of the process. In order to grit blast a metal surface, a large quantity of special grit has to be shipped to the location of the metal surface. Furthermore, once the coating has been removed from the metal surface, the used grit must be properly disposed.

Recently, ultra-pressure water blasting has been used instead of grit blasting. Many of the problems associated with grit blasting are not a factor with ultra-pressure water blasting. It has been found that water blasting has a stripping rate of approximately 3–5 minutes per square foot which is up to three times faster than grit blasting. Inhibitors can be added to the water to prevent "rust bloom" from forming on the newly cleaned metal surface. Furthermore, water blasting provides a cleaner metal surface than grit blasting, and the problems of grit transportation and disposal are obviated under this method. However, ultra-pressure water blasting still does not have a high enough stripping rate to be economically feasible for large scale stripping of old coatings.

It has been discovered that heating a coating to about 200° C. completely destroys the bond of the coating to metal surfaces for most organic coatings. However, the use of radiant and convective heat to remove coatings from thick metal surfaces proved problematic since the heat transfer through the coating is poor. The poor heat transfer causes the coating to become charred thereby releasing noxious gases. Furthermore, the use of radiant or convective heating provide inefficient stripping rates for coatings bonded to thick metal surfaces.

Therefore, a need existed to provide an improved method and apparatus for removing coatings from metal surfaces. The improved apparatus and method will use induction heating to remove the coating from the metal surfaces. The improved apparatus and method must also have a high enough stripping rate to be economically feasible for large scale stripping of old coatings and must not have the logistic problems associated with current stripping apparatuses and methods. The improved apparatus will be able to be manually moved across a metal surface. The improved apparatus can also be coupled to a remotely-operated utility vehicle which magnetically attaches itself to metal surfaces and is able to move about on the metal surface with high levels of precision and mobility while carrying the improved stripping apparatus as well as other types of equipment and payloads.

SUMMARY OF THE INVENTION

In accordance with one embodiment of the present invention, it is an object of the present invention to provide an improved apparatus and method for removing coatings from metal surfaces.

It is another object of the present invention to provide an improved apparatus and method for removing coatings from metal surfaces which uses induction heating to remove the coating from the metal surface.

It is another object of the present invention to provide an improved apparatus and method for removing coatings from metal surfaces which has a high enough stripping rate to be economically feasible for large scale stripping of old coatings.

It is another object of the present invention to provide an improved apparatus and method for removing coatings from metal surfaces which does not have the logistic problems associated with current stripping apparatuses and methods.

It is still another object of the present invention to provide a remotely-operated utility vehicle which magnetically attaches itself to metal surfaces and is able to move about on the metal surface with high levels of precision and mobility while carrying task-specific payload equipment such as an induction heating apparatus.

BRIEF DESCRIPTION OF THE PREFERRED EMBODIMENTS

In accordance with one embodiment of the present invention, an apparatus for heating a metal surface to remove a coating therefrom is disclosed. The apparatus is comprised of a power supply means for providing a source of power for the apparatus, and a coil assembly means coupled to the power supply means for induction heating of the metal surface in order to remove the coating from the metal surface. The coil assembly is comprised of an induction coil means coupled to the power supply means for high frequency induction heating of the metal surface in order to destroy the interface bond between the coating and the metal surface. A support plate means is coupled to the induction coil means for holding the induction coil means. A support structure means is coupled to the support plate for supporting the support plate. A dielectric sheet means may be coupled to the support structure means for providing an electrically nonconductive covering for the exposed side of the induction coil means.

In accordance with another embodiment of the present invention, a method for removing a coating from a metal surface is disclosed. The method is comprised of the steps of: heating the coating on the metal surface by electrical induction to decrease the bond strength between the coating and the metal surface; and removing the coating from the metal surface. The coating on the metal surface should be treated by electrical induction heating for about 30–60 seconds per square foot. Once the coating has been heated, the coating can be removed by scraping the coating from the metal surface.

In accordance with another embodiment of the present invention, a remotely-operated utility vehicle which attaches to metal surfaces and is able to move and carry payloads, such as an induction heating apparatus, on a metal surfaces is disclosed. The utility vehicle is comprised of a plurality of wheel assembly means for moving the utility vehicle. A steering means is coupled to each of the plurality of wheel assembly means for controlling the direction in which the utility vehicle moves. A motor means is coupled to the steering means for driving the plurality of wheel assembly means so the utility vehicle can move. A chassis means is coupled to the plurality of wheel assembly means for supporting the steering means and the motor means. A magnetic case unit means is coupled to the plurality of wheel assembly means for attaching the utility vehicle to metal surfaces.

In accordance with another embodiment of the present invention, a method of providing a remotely-operated utility vehicle which attaches to metal surfaces and is able to move and carry payloads, such as an induction heating apparatus, on metal the surfaces is disclosed. The method comprises the steps of: providing a plurality of wheel assembly means for moving the utility vehicle; providing steering means coupled to each of the plurality of wheel assembly means for controlling the direction in which the utility vehicle moves; providing motor means coupled to the steering means for driving the plurality of wheel assembly means so the utility vehicle can move; providing chassis means coupled to the plurality of wheel assembly means for supporting the steering means and the motor means; and providing magnetic case unit means coupled to the plurality of wheel assembly means for attaching the utility vehicle to metal surfaces.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENTS

Figure 1:
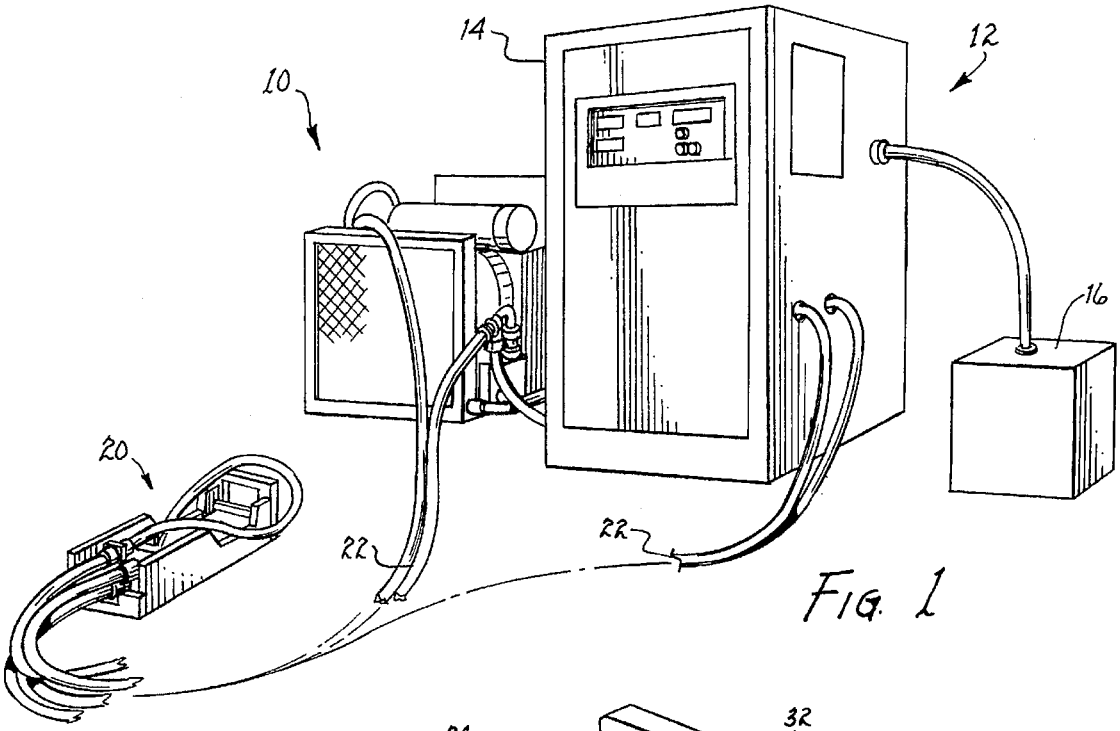
FIG. 1 is a perspective view of the induction heating apparatus of the present invention.

Referring to FIGS. 1–4, wherein like numerals and symbols designate like elements, an induction heating apparatus 10 (hereinafter apparatus 10) of the present invention is shown. The apparatus is comprised of a power supply unit 12. The power supply unit 12 is comprised of a solid state power unit 14. In the preferred embodiment of the present invention, the solid state power unit 14 has a 100 kW, 10 kHz output arranged for use with a 480 V, 3-phase, 60 Hz power input. The solid state power unit 14 is coupled to a transformer 16.

The transformer 16 modifies the output voltage and current to the coil assembly unit 20 of the apparatus 10. In the preferred embodiment of the present invention, the output of the transformer 16 is 100 V. The transformer 16 is coupled to the solid state power unit 14 and the coil assembly unit 20 by water cooled, high frequency power transmission cables 22.

Figure 2:
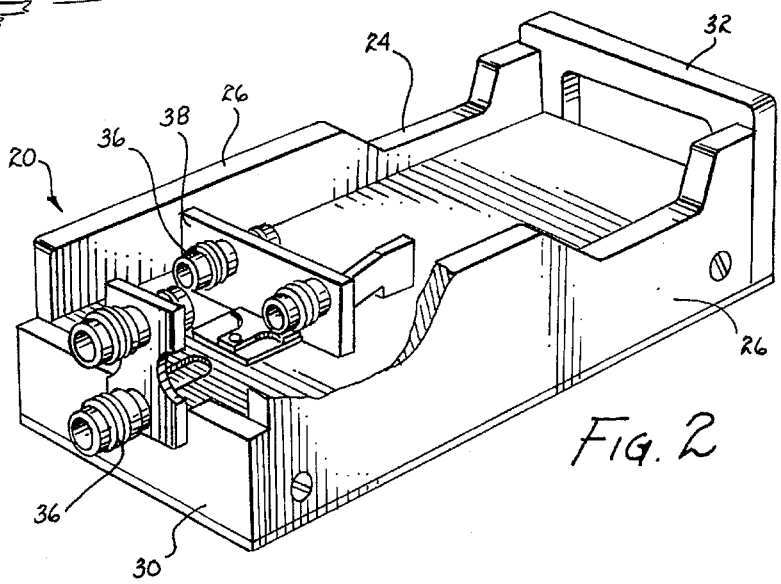
FIG. 2 is a perspective view of the coil assembly unit of the induction heating apparatus of FIG. 1.
Figure 3:
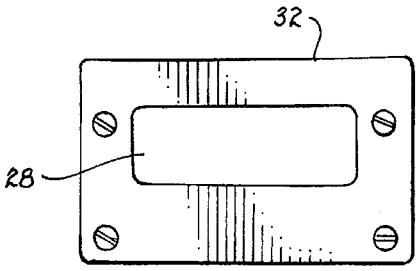
FIG. 3 is a front view of the handle portion of the coil assembly unit of FIG. 2.
Figure 4:
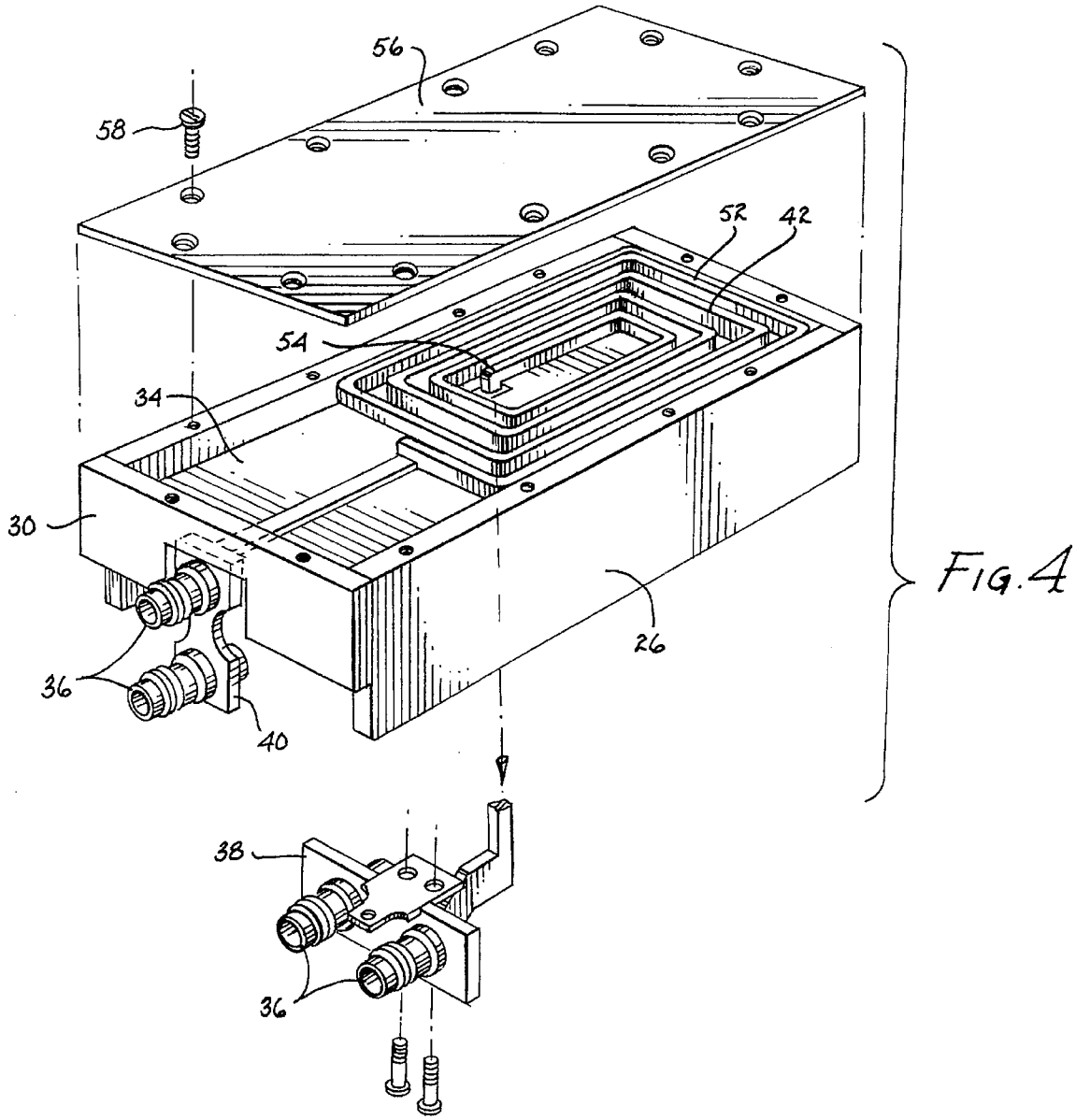
FIG. 4 is an exploded bottom view of the induction heating apparatus of FIG. 1.

Referring specifically to FIGS. 2–4, the coil assembly unit 20 is shown in further detail. The coil assembly unit 20 has a support structure 24 comprising of a pair of side boards 26 coupled together by end boards 30, 32. One of the end boards 32 has a handle opening 28 therein for manually moving the coil assembly unit 20 across a metal surface having an old coating that needs to be removed. It should be noted that the coil assembly unit 20 may also be coupled to a remotely-operated vehicle which magnetically attaches to metal surfaces. The remotely-operated vehicle may then carry and manipulate the coil assembly unit 20 over the coated metal surface. A vehicle for doing such operation will be described later on in the specification.

A support plate 34 is coupled to the side boards 26 and end boards 30, 32. An induction coil 42 is coupled to the support plate 34. The induction coil 42 produces a high frequency inductive field which will penetrate through a nonferrous coating with virtually no attenuation and will induce an eddy current of sufficient power in the underlying metal substrate to rapidly heat the interface to a high enough temperature to immediately destroy the interface bond between the coating and the substrate.

Figure 5:
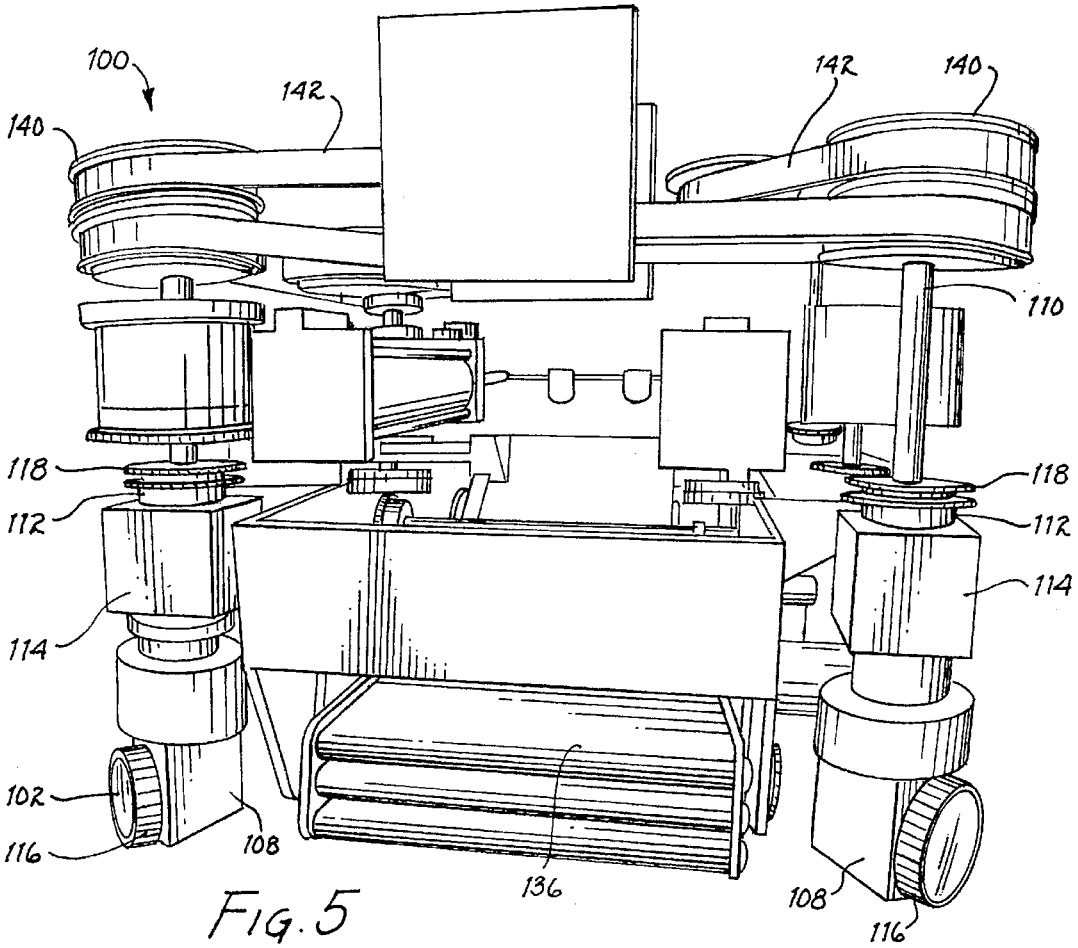
FIG. 5 is a front view of the remotely-operated utility vehicle of the present invention with the chassis plates removed.
Figure 6:
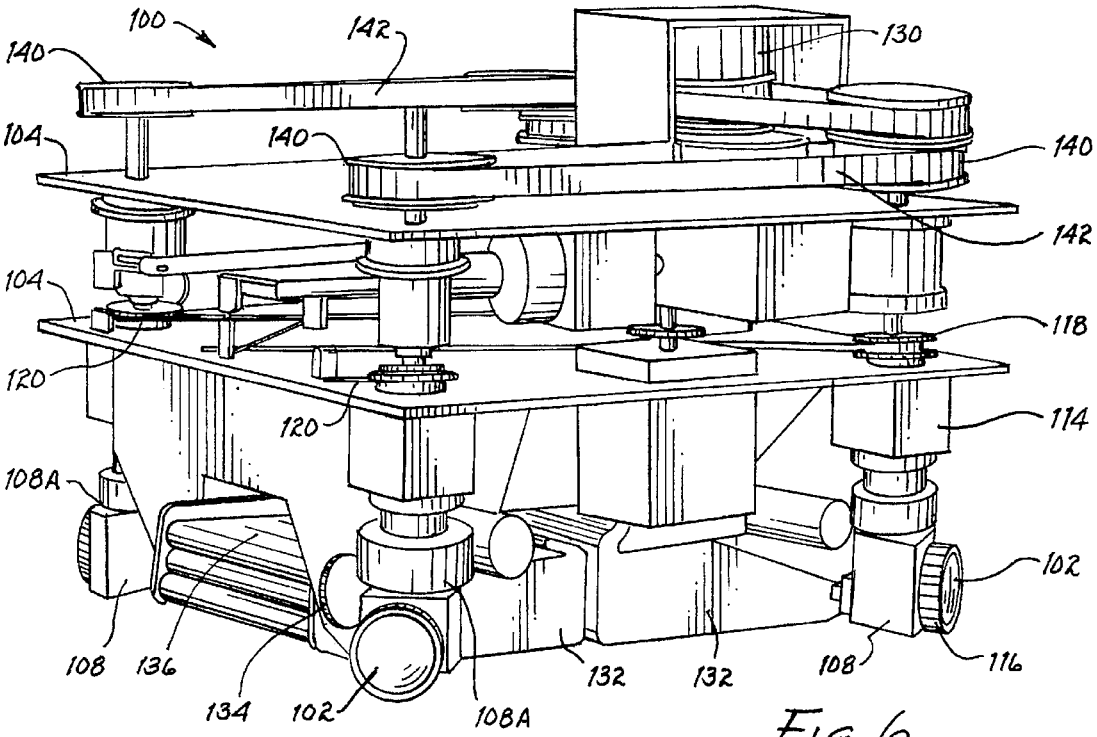
FIG. 6 is a perspective view of the remotely-operated utility vehicle of FIG. 5 with the chassis plates depicted.
Figure 7:
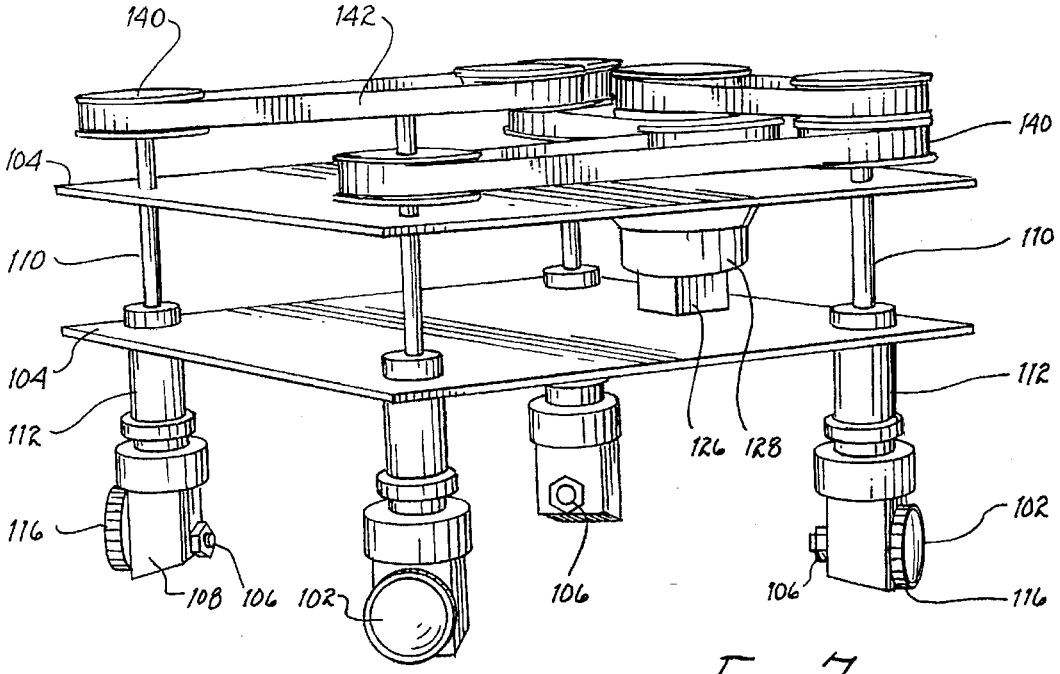
FIG. 7 is a perspective view of the main drive train system of the remotely-operated utility vehicle of FIG. 5.
Figure 8:
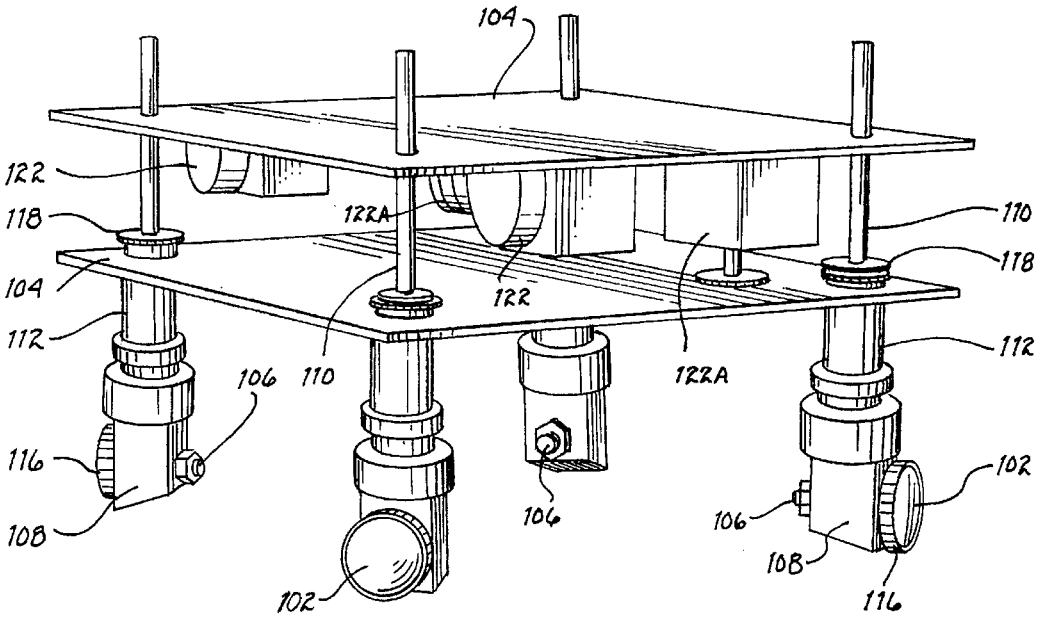
FIG. 8 is a perspective view of the steering system of the remotely-operated utility vehicle of FIG. 5.
Figure 9:
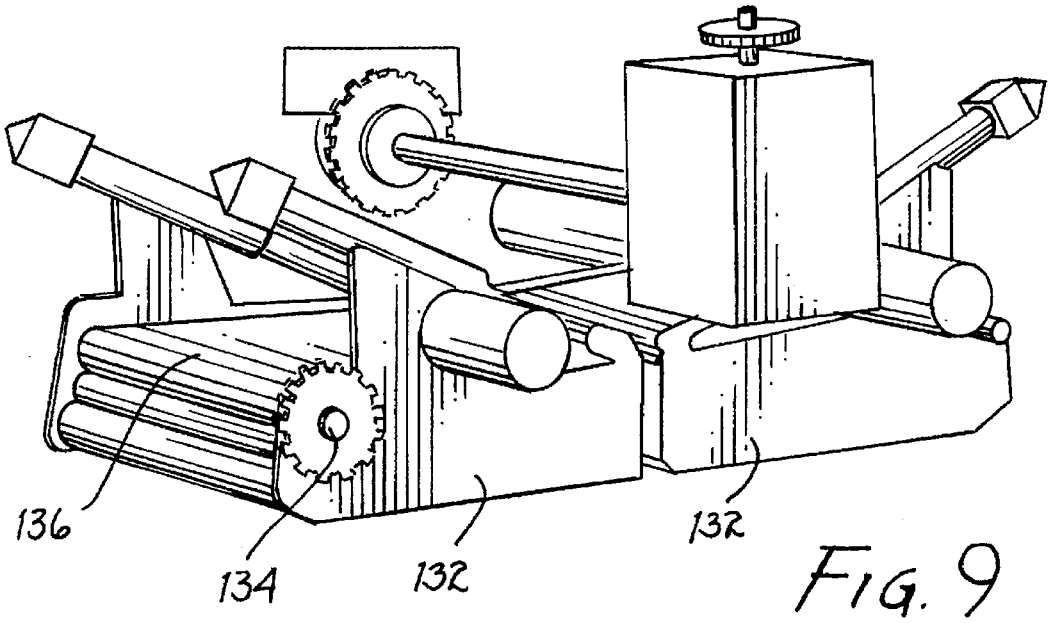
FIG. 9 is a perspective view of the magnetic case units of the remotely-operated utility vehicle of FIG. 5.

The induction coil 42 consist of a hollow tubing having a rectangular cross section. In the preferred embodiment of the present invention, the induction coil 42 is comprised of copper tubing which is formed into a rectangular shape spiral (see FIG. 5). The inside loop 54 terminates with a copper bus bar 38 to which two fittings 36 are brazed. Each of the fittings 36 serves the dual purposes of providing a water connection and an electrical connection for the water cooled, high frequency power transmission cables 22. Similarly, the outside loop 52 of the induction coil 42 terminates with a second copper bus bar 40 also having two fittings 36.

As states above, the induction coil 42 is coupled to the support plate 34. A dielectric sheet 56 is removably coupled to the side boards 26 and end boards 30, 32 by screws 58 so that the dielectric sheet 56 can be replaced when necessary. The dielectric sheet 56 provides an electrically nonconductive covering for the exposed said of the induction coil 42.

OPERATION

The operation of the preferred embodiment of apparatus 10 is as follows. An input of 480 V and 60 Hz is applied to the solid state power supply 14. The solid state power supply 14 provides an output of 100 kW, 10 kHz and 800 V. This is inputted into the transformer 16 which outputs a decreased voltage of 100 V with an increased current. The power supplied to the induction coil 42 by the transformer 16 is about 75–100 kW and the frequency is about 10–40 kHz. However, it should be noted that the induction coil assembly 20 can operated at power levels as low as about 25 kw.

While the effects of induction heating can be observed at all frequencies, it is only at high frequencies above about 10 kHz that the efficiency of the process becomes useful. At lower frequencies substantially the entire thickness of the metal substrate experiences primary heating from the $I^2R$ of the induced eddy current and therefore several deleterious effects result:

1) the electrical efficiency of the process is low because the entire cross section of the substrate is being heated; and
2) any coatings or heat sensitive substance on the opposite side of the metal substrate will suffer nearly equal degradation as the coating on the front surface.

At high frequencies, the magnetic field created by the induction coil 42 only penetrates a very short distance into the metal substrate and thus, the induced eddy current is confined effectively to the front surface of the metal substrate. Provided that the power density is sufficiently high, it is possible to rapidly heat a given area of the interface and destroy the coating bond and then move the induction coil to a new area before much secondary heating (heating by conduction from the surface layer) of the underlying volume of metal substrate occurs. In actual practice, rather than moving the coil assembly unit 20 to a spot and pausing for it to strip the area before moving to another spot, the coil assembly unit 20 would be moved continuously in a pattern of abutting swaths wherein each square foot of coating is heated for approximately 30–60 seconds. The higher the frequency, the tighter the primary heating is confined near the interface, and therefore, the greatest overall efficiency is obtained at the highest practical operating frequency. The practical range of operating frequencies is from about 10 kHz to 500 kHz but the optimum frequency for a given application depends upon the thickness of the metal substrate (ideally about 1–8 cm), thickness of the coating (ideally 2–10 mm), the temperature sensitivity of the coating, the electrical resistivity, thermal resistivity and magnetic permeability of the substrate, the proximity of thin induction coil to the metal substrate which can be maintained, and other such factors.

Once the coil assembly unit 20 is moved across the metal substrate, the coating may be removed. The coating may be manually removed with tools such as a hand scrapper or, if a remotely-operated vehicle was used to move the coil assembly unit 20, a scraping tool may be coupled to the vehicle to remove the coating.

MAGNETIC REMOTELY-OPERATED VEHICLE

The coil assembly unit 20 may be moved manually across a coated metal substrate, or a remotely-operated vehicle, which magnetically attaches to the metal substrate, may carry and manipulate the coil assembly unit 20 over the coated metal surface. Referring to FIGS. 5–9 where like numerals and symbols designate like elements, a remotely-operated utility vehicle 100 (hereinafter vehicle 100) of the present invention is shown. The vehicle 100 is comprised of a plurality of wheels 102, square chassis plates 104, and two independently movable magnet case units 132 which are situated in tandem along the front to rear centerline of the chassis plates 104.

Each of the wheels 102 is mounted on a horizontal output shaft 106 of an angle drive unit 108. The angled drive unit 108 is located with its vertical centerline intersecting and orthogonal to a vertex of the square chassis plates 104. The angle drive unit 108 is comprised of an internal miter gear set which is driven by a vertical input shaft 110 which is housed within a vertical tube shaft 112. The vertical tube shaft 112 is coupled to one of the chassis plates 104 by a bearing block 114. The internal miter gear set of the angle drive unit 108 have a 1:1 ratio which, when combined with the 1:1 ratio of the wheel diameter to the wheel outboard distance, produces the effect that whenever the vertical tube shaft 112 is rotated (as to align the wheel 102 to a different direction), the wheel 102 naturally spins the correct number of revolutions (or part thereof) to accommodate the rolling motion (displacement) without scuffing or binding. The wheels 102 are designed with a spherical profile on the outer circumference which is uniformly covered with small angular teeth 116. The teeth 116 provide an isotropic contact patch of maximum grip on metal surfaces regardless of whether the wheels 102 are experiencing lateral or longitudinal sliding forces.

Each of the angle drive units 108 is steered in synchronization with the other angle drive units 108 regardless of whether the vehicle 100 is traveling in a straight line or traveling a complex curve. In accordance with one embodiment of the present invention, the steering synchronization is accomplished by coupling equal diameter sprockets 118 to the top of each of the vertical tube shafts 112. A first sprocket 118, which is located on a left front vertical tube shaft 112, is coupled to a corresponding second sprocket 118 which is located diagonally opposite the first sprocket 118. The first sprocket 118 and the corresponding second sprocket 118 are coupled together by a roller chain 120 so that the two angle drive units 108 coupled to both the first and second sprockets 118 are always steered in locked synchronization (i.e. the wheels 102 are mechanically locked in parallel alignment with each other regardless of the direction they are steered to). Likewise, a third sprocket 118, which is located on a right front vertical tube shaft 112, is coupled to a corresponding fourth sprocket 118 which is located diagonally opposite the third sprocket 118. The third sprocket 118 and the corresponding fourth sprocket 118 are coupled together by a roller chain 120 so that the two angle drive units 108 coupled to both the third and fourth sprockets 118 are always steered in locked synchronization. A first steering motor 122 with a first gear box 122A is connected by a roller chain 120 to the first sprocket 118. Likewise, a second steering motor 122 with a second gear box 122A is connected by a roller chain 120 to the third sprocket 118. The first and second steering motors 122 rotates the first sprocket 118 and the third sprocket 118 respectively. This in turn rotates the third and fourth sprockets 118. This allows the wheels 102 to be aligned in any direction.

A drive sprocket 140 is coupled to each of the vertical input shafts 110. A main motor 126 is coupled to each drive sprocket 140 by cog belt 142. The main motor 126 is used to power the vehicle 100 so the vehicle 100 can move on the metal surface.

Most of the time, the first and second steering motors 122 are slaved together so that all of the vertical tube shafts 112 stay in perfect synchronization. The vehicle 100 therefore maintains a constant orientation (i.e. the chassis plates 104 remain pointed in the same direction with respect to the plane it is traveling upon regardless of the direction it travels and regardless of the changes in direction of travel). This is called the "fixed orientation mode". When it is necessary to change the orientation of the vehicle 100, the "spin mode" is engaged by unslaving the first and second steering motors 122 and directing each steering motor 122 to a fixed position such that each of the wheels 102 are aligned with their horizontal output shaft 106 pointing to the geometric center of the chassis plates 104. In this mode, the locomotion power delivered by a main motor 126 to the drive sprockets 140 located on the left side of the vehicle 100 is reversed with respect to that delivered to the drive sprockets 140 located on the right side of the vehicle 100 by means of a reversing transmission 130. In this mode, the vehicle 100 can be directed to spin either in a clockwise or counterclockwise manner to change the orientation of the chassis plates 104 with respect to the plane of travel.

In accordance with another embodiment of the present invention, the steering synchronization is accomplished by having a steering motor 122 and a gearbox 122A directly driving each of the vertical tube shafts 112. Under this embodiment, the vehicle 100 may operate in one of three modes: fixed orientation mode, spin mode, or "variable orientation mode". The first two have already been described above. The variable orientation mode requires a microprocessor to co-ordinate the actions of each of the steering motors 122 and the main motor 126. In this mode, a change in the direction of travel is accomplished by incrementally changing the orientation or heading of the entire chassis plates 104, so that the front of the chassis plates 104 is always pointing in the direction which the machine is traveling. When for example a left turn of radius R=X is to be executed, the microprocessor instructs the steering motors 122 coupled to the wheels 102 located on the left side of the vehicle 100 to align the wheels 102 to a theoretical radius of R=X−W/2 (where W=the track width of the chassis plate 104) and instructs the steering motors 122 coupled to the wheels 102 located on the right side of the vehicle 100 to align the wheels 102 to a theoretical radius of R=X+W/2. Simultaneously, the microprocessor instructs the main motor 126 to drive the wheels 102 on the left side of the vehicle 100 at a speed of S=X−W/2 radians per second and to drive the wheels 102 on the right side of the vehicle at a speed of S=X+W/2 radians per second.

Magnetic attraction to the metal surface is provided by two magnet cases 132. The magnet cases 132 are maintained at a predetermined standoff distance from the work surface (approximately 0.5 inches) to allow the magnet cases 132 to clear minor surface irregularities. Each magnet case 132 is mounted on a pivoting shaft 134 to permit the vehicle 100 to traverse over abrupt angles or irregularities on the work surface. The magnet cases 132 are also provided traction belts 136 which encircle the magnet cases 132 and thus prevent the magnet cases 132 from directly contacting the work surface and dragging. The traction belts 136 also provide a self-cleaning function in the event that small loose ferrous objects are picked up by the magnet cases 132.

To maintain all the wheels 102 in contact on non-planar surfaces, a balance mechanism 108A is built into angle drive units 108 located on the front end of the vehicle 100. The balance mechanism 108A allows one angle drive unit 108 to move upward (i.e. if one front wheel 102 encounters a bump on the work surface) with respect to the chassis plates 104 and transfers an equal but opposite force of movement to the opposite front wheel 102. This maintains an equal distribution of the load between these two wheels 102.

While the invention has been particularly shown and described with reference to preferred embodiments thereof, it will be understood by those skilled in the art that the foregoing and other changes in form and details may be made therein without departing from the spirit and scope of the invention.

I claim:

1. An apparatus for heating a metal surface to remove a nonferrous thermosetting resin coating bonded to said metal surface comprising, in combination:

power supply means coupled to a 480 V, 3-phase, 60 Hz power input for providing an approximately 75–100 kW signal at approximately 10–40 kHz to said apparatus; and coil assembly means coupled to said power supply means for producing a high frequency inductive field which will penetrate through said nonferrous thermosetting resin coating with virtually no attenuation and will induce an eddy current of sufficient power in an underlying metal substrate to rapidly heat the interface to a sufficient temperature to immediately destroy the interface bond between said nonferrous thermosetting coating and said metal substrate.

2. An apparatus in accordance with claim 1 wherein said power supply means comprises:

solid state power unit means for supplying power to said apparatus; and transformer means coupled to said solid state power unit means and said coil assembly means for adjusting a voltage from said solid state power unit means to conform to a voltage required by said coil assembly means.

3. An apparatus in accordance with claim 2 further comprising water cooled flexible transmission cable means for coupling said transformer means to said solid state power unit means and said coil assembly means.

4. An apparatus in accordance with claim 1 wherein said coil assembly means comprises:

induction coil means coupled to said power supply means for high frequency induction heating of said metal surface in order to remove said coating from said metal surface;

support plate means coupled to said induction coil means for holding said induction coil means; and support structure means coupled to said support plate for supporting said support plate means.

5. An apparatus in accordance with claim 4 wherein said induction coil means comprises a copper tubing.

6. An apparatus in accordance with claim 4 wherein both ends of said induction coil means are coupled to said support plate by a bus bar.

7. An apparatus in accordance with claim 6 further comprising fitting means coupled to said copper bus bar for coupling said coil assembly means to said power supply means with water cooled flexible transmission cables.

8. An apparatus in accordance with claim 4 further comprising dielectric sheet means coupled to said support structure means for providing an electrically nonconductive covering for said induction coil means.

9. An apparatus in accordance with claim 4 wherein said support structure means further comprises handle means coupled to one end of said support structure means for manually moving said apparatus across said metal surface to remove said coating.

* * * * *